US008257229B2

(12) United States Patent
Myers et al.

(10) Patent No.: US 8,257,229 B2
(45) Date of Patent: Sep. 4, 2012

(54) PLAY GYMS AND METHODS OF OPERATING THE SAME

(75) Inventors: Peter J. Myers, Wheaton, IL (US); Joseph Paul Sejnowski, North Kingstown, RI (US)

(73) Assignee: Kolcraft Enterprises, Inc., Chicago, IL (US)

( * ) Notice: Subject to any disclaimer, the term of this patent is extended or adjusted under 35 U.S.C. 154(b) by 483 days.

(21) Appl. No.: 12/062,670

(22) Filed: Apr. 4, 2008

(65) Prior Publication Data

US 2008/0188355 A1 Aug. 7, 2008

Related U.S. Application Data

(63) Continuation of application No. 10/725,071, filed on Dec. 1, 2003, now Pat. No. 7,376,993, which is a continuation of application No. 10/431,079, filed on May 7, 2003, now abandoned.

(51) Int. Cl.
*A63B 21/00* (2006.01)

(52) U.S. Cl. ..... 482/35; 482/148; 135/125; 135/127; 135/128; 52/82

(58) Field of Classification Search ..... 482/35; 135/125, 126, 127, 135, 128; 52/82
See application file for complete search history.

(56) References Cited

U.S. PATENT DOCUMENTS

| | | | | |
|---|---|---|---|---|
| 1,574,226 A | | 2/1926 | Ackermann | |
| 1,630,941 A | | 5/1927 | Hood | |
| 1,826,810 A | | 10/1931 | Morishita | |
| 2,065,225 A | | 12/1936 | Kennedy | |
| 2,402,861 A | | 6/1946 | Winnick | |
| 2,433,504 A | | 12/1947 | Zimmermann | |
| 2,464,866 A | | 3/1949 | Holtz | |
| 2,475,515 A | * | 7/1949 | Potter | 135/125 |
| 2,498,203 A | | 2/1950 | Fischer | |
| D158,030 S | | 4/1950 | Wagner | |
| 2,681,659 A | | 6/1954 | Hrinsin | |
| 2,699,794 A | | 1/1955 | Potter | |
| 2,820,468 A | | 1/1958 | Park et al. | |

(Continued)

FOREIGN PATENT DOCUMENTS

CN 2650639 10/2004

(Continued)

OTHER PUBLICATIONS

"Third Party Inter Partes Reexamination Requestor's Comments Pursuant to 37 CFR § 1.947," filed with the United States Patent and Trademark Office in connection with U.S. Appl. No. 95/000,514, corresponding to US patent 7,376,993 issued from U.S. Appl. No. 10/725,071, filed Oct. 18, 2010, 39 pages.

(Continued)

*Primary Examiner* — Jerome W Donnelly
(74) *Attorney, Agent, or Firm* — Hanley, Flight & Zimmerman, LLC

(57) ABSTRACT

Play gyms and methods of operating the same are disclosed. A disclosed example includes a floor mat dimensioned to be positioned within a play yard and/or a bassinet. It also includes a play gym to suspend an object above the mat when the mat is positioned in the play yard and/or the bassinet, and at least one connector to couple the play gym to the mat when the mat is removed from the play gym and/or the bassinet.

6 Claims, 5 Drawing Sheets

U.S. PATENT DOCUMENTS

| | | | | |
|---|---|---|---|---|
| 2,927,331 | A | 3/1960 | Ruiz | |
| RE24,845 | E | 7/1960 | Heffernan et al. | |
| 2,948,287 | A * | 8/1960 | Rupert | 135/126 |
| 2,958,084 | A | 11/1960 | Kenney | |
| 2,962,034 | A | 11/1960 | Finlayson | |
| 3,223,098 | A * | 12/1965 | Dole, Jr. | 135/126 |
| 3,448,748 | A * | 6/1969 | Walrave | 135/127 |
| 3,546,721 | A | 12/1970 | Cleary | |
| 3,706,105 | A | 12/1972 | Nicholas et al. | |
| 3,878,570 | A | 4/1975 | Donnelly | |
| 3,978,610 | A | 9/1976 | Stubbmann | |
| 4,015,297 | A | 4/1977 | Christian | |
| 4,043,349 | A | 8/1977 | Gays et al. | |
| 4,073,017 | A | 2/1978 | Stevens | |
| 4,188,745 | A | 2/1980 | Harvey et al. | |
| 4,192,334 | A | 3/1980 | Daws | |
| 4,556,391 | A | 12/1985 | Tardivel et al. | |
| D285,880 | S | 9/1986 | Griesenbeck | |
| 4,627,588 | A | 12/1986 | Block | |
| 4,637,748 | A | 1/1987 | Beavers | |
| 4,664,640 | A | 5/1987 | Shindo et al. | |
| 4,702,643 | A | 10/1987 | Thilmony | |
| 4,722,713 | A | 2/1988 | Williams et al. | |
| 4,750,509 | A | 6/1988 | Kim | |
| D298,768 | S | 11/1988 | Dwosh et al. | |
| 4,790,340 | A | 12/1988 | Mahoney | |
| 4,811,437 | A | 3/1989 | Dillner et al. | |
| 4,852,598 | A | 8/1989 | Griesenbeck | |
| 4,901,481 | A | 2/1990 | Seeley, Jr. | |
| 4,945,584 | A * | 8/1990 | LaMantia | 5/97 |
| 5,025,821 | A | 6/1991 | Page et al. | |
| 5,069,572 | A | 12/1991 | Niksic | |
| 5,076,520 | A | 12/1991 | Bro | |
| 5,161,269 | A | 11/1992 | McLean et al. | |
| 5,195,551 | A | 3/1993 | Ju | |
| D335,046 | S | 4/1993 | Diaz | |
| D339,922 | S | 10/1993 | Williams | |
| 5,293,890 | A | 3/1994 | Park et al. | |
| 5,328,286 | A | 7/1994 | Lee | |
| 5,333,634 | A * | 8/1994 | Taylor | 135/98 |
| 5,339,470 | A | 8/1994 | Shamie | |
| 5,356,132 | A | 10/1994 | McEwan et al. | |
| 5,370,570 | A | 12/1994 | Harris | |
| D359,869 | S | 7/1995 | Oren | |
| 5,478,268 | A | 12/1995 | Au | |
| D366,978 | S | 2/1996 | Mariol | |
| D367,788 | S | 3/1996 | Lawhorn | |
| 5,517,707 | A | 5/1996 | LaMantia | |
| 5,553,336 | A | 9/1996 | Mariol | |
| D374,692 | S | 10/1996 | Stroud et al. | |
| 5,586,345 | A | 12/1996 | Nielsen et al. | |
| 5,672,088 | A | 9/1997 | Chininis | |
| 5,697,111 | A | 12/1997 | Dillner et al. | |
| 5,778,465 | A | 7/1998 | Myers | |
| 5,819,342 | A | 10/1998 | Williams | |
| 5,862,548 | A | 1/1999 | Gerhart | |
| 5,867,850 | A | 2/1999 | Mariol | |
| D408,192 | S | 4/1999 | Chiang | |
| 5,904,344 | A | 5/1999 | Pope et al. | |
| 5,928,054 | A | 7/1999 | Mast | |
| 5,930,854 | A | 8/1999 | O'Neill et al. | |
| 5,951,360 | A | 9/1999 | Fearon et al. | |
| 5,987,822 | A | 11/1999 | McNiff et al. | |
| 5,991,943 | A | 11/1999 | Morris | |
| 6,041,455 | A | 3/2000 | Raffo et al. | |
| 6,067,676 | A | 5/2000 | Carnahan et al. | |
| 6,109,280 | A | 8/2000 | Custer | |
| 6,113,455 | A | 9/2000 | Whelan et al. | |
| 6,123,091 | A | 9/2000 | Flynn et al. | |
| D435,883 | S | 1/2001 | Laosunthara et al. | |
| 6,178,978 | B1 | 1/2001 | Rieber | |
| 6,192,535 | B1 | 2/2001 | Warner, Jr. et al. | |
| 6,199,230 | B1 | 3/2001 | Parikh | |
| 6,200,060 | B1 | 3/2001 | Vernay | |
| 6,250,837 | B1 | 6/2001 | Mariol et al. | |
| 6,296,415 | B1 | 10/2001 | Johnson et al. | |
| 6,301,731 | B1 | 10/2001 | Jakubowski et al. | |
| 6,305,037 | B1 | 10/2001 | Cheng | |
| 6,336,234 | B1 | 1/2002 | Kuo | |
| 6,345,639 | B2 | 2/2002 | Rousselle et al. | |
| 6,357,462 | B1 * | 3/2002 | Laosunthara et al. | 135/96 |
| 6,418,575 | B1 | 7/2002 | Cheng | |
| 6,464,555 | B1 | 10/2002 | Paduano | |
| 6,467,107 | B1 | 10/2002 | Glover et al. | |
| 6,510,569 | B1 | 1/2003 | Hu | |
| 6,516,823 | B1 | 2/2003 | Glover et al. | |
| 6,539,563 | B1 | 4/2003 | Hsia | |
| 6,561,823 | B1 | 5/2003 | Konno | |
| 6,578,211 | B2 | 6/2003 | Tharalson et al. | |
| 6,604,844 | B2 | 8/2003 | Hussey | |
| 6,640,985 | B1 | 11/2003 | Cheng | |
| 6,679,643 | B1 | 1/2004 | Ham, II | |
| 6,702,643 | B1 * | 3/2004 | Drosendahl et al. | 446/227 |
| 6,711,760 | B1 | 3/2004 | Yang | |
| 6,735,796 | B2 | 5/2004 | Warner, Jr. et al. | |
| 6,785,921 | B1 | 9/2004 | Conforti | |
| 6,810,545 | B1 | 11/2004 | Darling et al. | |
| 7,036,161 | B2 | 5/2006 | Harrison et al. | |
| 7,037,170 | B2 | 5/2006 | Pacella et al. | |
| 7,040,585 | B2 * | 5/2006 | Cheng et al. | 248/200 |
| 7,096,874 | B2 * | 8/2006 | Forshpan | 135/96 |
| 7,153,181 | B2 | 12/2006 | Cheng et al. | |
| 7,376,993 | B2 | 5/2008 | Myers et al. | |
| 2002/0023673 | A1 | 2/2002 | Hussey | |

FOREIGN PATENT DOCUMENTS

| | | |
|---|---|---|
| CN | 2689824 | 4/2005 |
| EP | 0930035 | 7/1999 |
| EP | 0930035 A1 | 7/1999 |
| EP | 0789526 | 10/2002 |
| NL | 8400112 | 8/1985 |

OTHER PUBLICATIONS

"Third Party Inter Partes Reexamination Requestor's Comments Pursuant to 37 CFR § 1.947," Exhibit Z, filed with the United States Patent and Trademark Office in connection with U.S. Appl. No. 95/000,514, corresponding to US patent 7,376,993 issued from U.S. Appl. No. 10/725,071, filed Oct. 18, 2010, 17 pages.

"Third Party Inter Partes Reexamination Requestor's Comments Pursuant to 37 CFR § 1.947," Exhibit AA, AA-1, filed with the United States Patent and Trademark Office in connection with U.S. Appl. No. 95/000,514, corresponding to US patent 7,376,993 issued from U.S. Appl. No. 10/725,07, filed Oct. 18, 2010, 11 pages.

"Third Party Inter Partes Reexamination Requestor's Comments Pursuant to 37 CFR § 1.947," Exhibit AA, AA-2, filed with the United States Patent and Trademark Office in connection with U.S. Appl. No. 95/000,514, corresponding to US patent 7,376,993 issued from U.S. Appl. No. 10/725,071, filed Oct. 18, 2010, 2 pages.

"Third Party Inter Partes Reexamination Requestor's Comments Pursuant to 37 CFR § 1.947," Exhibit AA, AA-3, filed with the United States Patent and Trademark Office in connection with U.S. Appl. No. 95/000,514, corresponding to US patent 7,376,993 issued from U.S. Appl. No. 10/725,071, filed Oct. 18, 2010, 3 pages.

"Third Party Inter Partes Reexamination Requestor's Comments Pursuant to 37 CFR § 1.947," Exhibit AA, AA-4, filed with the United States Patent and Trademark Office in connection with U.S. Appl. No. 95/000,514, corresponding to US patent 7,376,993 issued from U.S. Appl. No. 10/725,071, filed Oct. 18, 2010, 2 pages.

"Third Party Inter Partes Reexamination Requestor's Comments Pursuant to 37 CFR § 1.947," Exhibit AA, AA-5, filed with the United States Patent and Trademark Office in connection with U.S. Appl. No. 95/000,514, corresponding to US patent 7,376,993 issued from U.S. Appl. No. 10/725,071, filed Oct. 18, 2010, 3 pages.

"Third Party Inter Partes Reexamination Requestor's Comments Pursuant to 37 CFR § 1.947," Exhibit AA, AA-6, filed with the United States Patent and Trademark Office in connection with U.S. Appl. No. 95/000,514, corresponding to US patent 7,376,993 issued from U.S. Appl. No. 10/725,071, filed Oct. 18, 2010, 3 pages.

"Third Party Inter Partes Reexamination Requestor's Comments Pursuant to 37 CFR § 1.947," Exhibit AA, AA-7, filed with the United States Patent and Trademark Office in connection with U.S. Appl.

No. 95/000,514, corresponding to US patent 7,376,993 issued from U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-8, filed with the United States Patent and Trademark Office in connection with U.S. Appl. No. 95/000,514, corresponding to US patent 7,376,993 issued from U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-9, filed with the United States Patent and Trademark Office in connection with U.S. Appl. No. 95/000,514, corresponding to US patent 7,376,993 issued from U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-10, filed with the United States Patent and Trademark Office in connection with U.S. Appl. No. 95/000,514, corresponding to US patent 7,376,993 issued from U.S. Appl. No. 10/725,071, filed Oct. 18, 2010, 6 pages.
"Third Party Inter Partes Reexamination Requestor's Comments Pursuant to 37 CFR § 1.947," Exhibit AA, AA-11, filed with the United States Patent and Trademark Office in connection with U.S. Appl. No. 95/000,514, corresponding to US patent 7,376,993 issued from U.S. Appl. No. 10/725,071, filed Oct. 18, 2010, 3 pages.
"Third Party Inter Partes Reexamination Requestor's Comments Pursuant to 37 CFR § 1.947," Exhibit AA, AA-12, filed with the United States Patent and Trademark Office in connection with U.S. Appl. No. 95/000,514, corresponding to US patent 7,376,993 issued from U.S. Appl. No. 10/725,071, filed Oct. 18, 2010, 12 pages.
"Third Party Inter Partes Reexamination Requestor's Comments Pursuant to 37 CFR § 1.947," Exhibit AA, AA-13, filed with the United States Patent and Trademark Office in connection with U.S. Appl. No. 95/000,514, corresponding to US patent 7,376,993 issued from U.S. Appl. No. 10/725,071, filed Oct. 18, 2010, 5 pages.
"Third Party Inter Partes Reexamination Requestor's Comments Pursuant to 37 CFR § 1.947," Exhibit BB, filed with the United States Patent and Trademark Office in connection with U.S. Appl. No. 95/000,514, corresponding to US patent 7,376,993 issued from U.S. Appl. No. 10/725,071, filed Oct. 18, 2010, 2 pages.
United States Patent and Trademark Office, "Inter Partes Reexamination Office Action Closing Prosecution" issued in connection with reexamination control No. 95000514, mailed on Nov. 2, 2011, 50 pages.
United States Patent and Trademark Office, "Inter Partes Reexamination Office Action Closing Prosecution" issued in connection with reexamination control No. 95000514, mailed on Jul. 16, 2010, 59 pages.
United States Patent and Trademark Office, "Decision Dismissing Petition" issued in connection with reexamination control No. 95000514, mailed on Jul. 25, 2011, 6 pages.
United States Patent and Trademark Office, "Office communication concerning application control No. 95000514" mailed on Jul. 1, 2011, 2 pages.
United States Patent and Trademark Office, "Notice of Inter Partes Reexamination Request Filing Date" issued in connection with reexamination control No. 95000514, mailed on Jan. 15, 2010, 1 page.
United States Patent and Trademark Office, "Notice of Assignment of Inter Partes Reexamination Request" issued in connection with reexamination control No. 95000514, mailed on Jan. 15, 2010, 1 page.
United States Patent and Trademark Office, "Decision Dismissing Petition Under 37 C.F.R. 1.182" issued in connection with U.S. patent No. 7,376,993 B2, mailed on Oct. 28, 2010, 6 pages.
United States Patent and Trademark Office, "Decision Granting Petition for Extension of Time [37 C.F.R. 1.956(c)]" issued in connection with U.S. Patent No. 7,376,993, mailed Jul. 28, 2010, 3 pages.
United States Patent and Trademark Office, "Office communication concerning Inter Partes Examination" issued in connection with reexamination control No. 95000514, mailed on May 12, 2010, 2 pages.
"Corrected Third Party Inter Partes Reexamination Requester's Comments Pursuant to 37 CFR 1.947" filed with the United States Patent and Trademark Office on May 27, 2010 in connection with reexamination control No. 95000514, corresponding to patent 7,376,993, 52 pages.
"Corrected Third Party Inter Partes Reexamination Requester's Comments Pursuant to 37 CFR 1.947" filed with the United States Patent and Trademark Office on Jul. 18, 2011 in connection with reexamination control No. 95000514, corresponding to patent 7,376,993, 50 pages.
"Third Party Inter Partes Reexamination Requester's Emergency Petition Under 37 CFR 1.183 Requesting Waiver of the Page Limitation Requirement Under 37 CFR 1.943(B)" filed with the United States Patent and Trademark Office on Jul. 5, 2011 in connection with reexamination control No. 95000514, corresponding to patent 7,376,993, 117 pages.
"Third Party Inter Partes Reexamination Requester's Comments Pursuant to 37 CFR 1.947" filed with the United States Patent and Trademark Office on Feb. 23, 2011, in connection with reexamination control No. 95000514, corresponding to patent 7,376,993, 117 pages.
"Third Party Inter Partes Reexamination Requester's Comments Pursuant to 37 CFR 1.947" filed with the United States Patent and Trademark Office on Apr. 12, 2010, in connection with reexamination control No. 95000514, corresponding to patent 7,376,993, 65 pages.
"Response to the Office Action dated Jul. 16, 2010," filed with the United States Patent and Trademark Office on Sep. 16, 2010, in connection with reexamination control No. 95000514, corresponding to patent 7,376,993, 29 pages.
"Rule 131 Declaration of Edward Bretschger filed in the Response to the Office Action dated Jul. 16, 2010," filed with the United States Patent and Trademark Office on Sep. 16, 2010, in connection with reexamination control No. 95000514, corresponding to patent 7,376,993, 32 pages.
*Kolcraft Enterprises, Inc.* v. *Graco Children's Products, Inc. and Chicco USA, Inc.*, "Complaint for Patent Infringement," filed with the United States District Court for the Northern District of Illinois, case No. 09-cv-03339, filed Jun. 3, 2009, 4 pages.
*Kolcraft Enterprises, Inc.* v. *Graco Children's Products, Inc. and Chicco USA, Inc.*, "Local Rule 3.4 Notice of Claims Involving Patents," filed with the United States District Court for the Northern District of Illinois, case No. 09-cv-03339, filed Jun. 3, 2009, 1 page.
*Kolcraft Enterprises, Inc.* v. *Graco Children's Products, Inc. and Chicco USA, Inc.*, "Notification of Docket Entry," issued by the United States District Court for the Northern District of Illinois, case No. 09-cv-03339, filed Jul. 9, 2009, 1 page.
*Kolcraft Enterprises, Inc.* v. *Graco Children's Products, Inc. and Chicco USA, Inc.*, "Notification of Docket Entry," issued by the United States District Court for the Northern District of Illinois, case No. 09-cv-03339, filed Aug. 5, 2009, 1 page.
*Kolcraft Enterprises, Inc.* v. *Graco Children's Products, Inc. and Chicco USA, Inc.*, "Defendant Chicco USA, Inc.'s Answer, Affirmative Defenses, and Counterclaims to Complaint," filed with the United States District Court for the Northern District of Illinois, case No. 09-cv-03339, filed Aug. 20, 2009, 22 pages.
*Kolcraft Enterprises, Inc.* v. *Graco Children's Products, Inc. and Chicco USA, Inc.*, "Defendant Chicco USA, Inc.'s Motion to Transfer Venue," filed with the United States District Court for the Northern District of Illinois, case No. 09-cv-03339, filed Aug. 20, 2009, 10 pages.
*Kolcraft Enterprises, Inc.* v. *Graco Children's Products, Inc. and Chicco USA, Inc.*, "Defendant Chicco USA, Inc.'s Memorandum of Law in Support of its Motion to Transfer Venue," with exhibits A-C, filed with the United States District Court for the Northern District of Illinois, case No. 09-cv-03339, filed Aug. 20, 2009, 22 pages.
*Kolcraft Enterprises, Inc.* v. *Graco Children's Products, Inc. and Chicco USA, Inc.*, "Docket Entry Text," issued by the United States District Court for the Northern District of Illinois, case No. 09-cv-03339, filed Aug. 26, 2009, 1 page.
*Kolcraft Enterprises, Inc.* v. *Graco Children's Products, Inc. and Chicco USA, Inc.*, "Plaintiff's Response to Chicco's Counterclaims," filed with the United States District Court for the Northern District of Illinois, case No. 09-cv-03339, filed Aug. 31, 2009, 7 pages.
*Kolcraft Enterprises, Inc.* v. *Graco Children's Products, Inc. and Chicco USA, Inc.*, "Plaintiff's Response to Defendant's Motion to Transfer," case 1:09-cv-03339, document 30, filed Sep. 11, 2009, 9 pages.
*Kolcraft Enterprises, Inc.* v. *Graco Children's Products, Inc. and Chicco USA, Inc.*, "Declaration of Thomas N. Koltun Support of Plaintiff's Response to Defendant's Motion to Transfer," filed with the United States District Court for the Northern District of Illinois, case No. 09-cv-03339, filed Sep. 11, 2009, 3 pages.
*Kolcraft Enterprises, Inc.* v. *Graco Children's Products, Inc. and Chicco USA, Inc.*, "Confidentiality Stipulation and Protective Order," filed with the United States District Court for the Northern District of Illinois, case No. 09-cv-03339, filed Sep. 14, 2009, 10 pages.
*Kolcraft Enterprises, Inc.* v. *Graco Children's Products, Inc. and Chicco USA, Inc.*, "Opinion and Order," issued by the United States District Court for the Northern District of Illinois,case No. 09-cv-03339, filed Oct. 23, 2009, 8 pages.
United States Patent and Trademark Office, "Notice of Allowance," issued in connection with U.S. Appl. No. 10/725,071, mailed Feb. 26, 2008, 6 pages.
United States Patent and Trademark Office, "Final Office Action," issued in connection with U.S. Appl. No. 10/725,071, mailed Aug. 21, 2007, 14 pages.
United States Patent and Trademark Office, "Non-Final Office Action," issued in connection with U.S. Appl. No. 10/725,071, mailed Nov. 30, 2006, 11 pages.
United States Patent and Trademark Office, "Non-Final Office Action," issued in connection with U.S. Appl. No. 10/725,071, mailed May 2, 2006, 11 pages.
United States Patent and Trademark Office, "Non-Final Office Action," issued in connection with U.S. Appl. No. 10/725,071, mailed Nov. 8, 2005, 10 pages.
United States Patent and Trademark Office, "Non-Final Office Action," issued in connection with U.S. Appl. No. 10/725,071, mailed Apr. 4, 2005, 17 pages.
*Kolcraft Enterprises, Inc.* v. *Graco Children's Products, Inc. and Chicco USA, Inc.*, "Defendant Chicco USA Inc.'s Motion to Stay the Proceedings Pending Reexamination of the Patent Suit," filed with the United States District Court for the Northern District of Illinois, case No. 09-cv-03339, filed Nov. 4, 2009, 2 pages.
*Kolcraft Enterprises, Inc.* v. *Graco Children's Products, Inc. and Chicco USA, Inc.*, "Notice of Motion," filed with the United States District Court for the Northern District of Illinois, case No. 09-cv-03339, filed Nov. 4, 2009, 1 page.
*Kolcraft Enterprises, Inc.* v. *Graco Children's Products, Inc. and Chicco USA, Inc.*, "Defendant Chicco USA, Inc.'s Memorandum of Law in Support of its Motion to Stay the Proceedings Pending Reexamination of the Patent Suit," filed with the United States District Court for the Northern District of Illinois, case No. 09-cv-03339, filed Nov. 4, 2009, 11 pages.
*Kolcraft Enterprises, Inc.* v. *Graco Children's Products, Inc. and Chicco USA, Inc.*, "Exhibits A and B," filed with the United States District Court for the Northern District of Illinois, case No. 09-cv-03339, filed Nov. 5, 2009, 6 pages.
*Kolcraft Enterprises, Inc.* v. *Graco Children's Products, Inc. and Chicco USA, Inc.*, "Notification of Docket Entry," issued by the United States District Court for the Northern District of Illinois, case No. 09-cv-03339, filed Nov. 13, 2009, 1 page.
Fisher Price, "Motion and Music Jungle Gym," Model No. 74067, 2003, 8 pages.
Graco, "Pack 'N Play," Owners Manual, Nov. 2001, 21 pages.
Century, "Playard with Bassinet/Changer," Fold-n-Go Care Center, Instruction Manual, Jan. 1998, 12 pages.
"Request for Inter Partes Reexamination," filed with the United States Patent and Trademark Office on Nov. 2, 2009, 120 pages.
"Request for Inter Partes Reexamination," Exhibit A, filed with the United States Patent and Trademark Office on Nov. 2, 2009, 12 pages.
"Request for Inter Partes Reexamination," Exhibit B, filed with the United States Patent and Trademark Office on Nov. 2, 2009, 10 pages.
"Request for Inter Partes Reexamination," Exhibit C, filed with the United States Patent and Trademark Office on Nov. 2, 2009, 13 pages.
"Request for Inter Partes Reexamination," Exhibit D, filed with the United States Patent and Trademark Office on Nov. 2, 2009, 36 pages.
"Request for Inter Partes Reexamination," Exhibit E, filed with the United States Patent and Trademark Office on Nov. 2, 2009, 7 pages.
"Request for Inter Partes Reexamination," Exhibit F, filed with the United States Patent and Trademark Office on Nov. 2, 2009, 16 pages.
"Request for Inter Partes Reexamination," Exhibit G, filed with the United States Patent and Trademark Office on Nov. 2, 2009, 7 pages.
"Request for Inter Partes Reexamination," Exhibit H, filed with the United States Patent and Trademark Office on Nov. 2, 2009, 17 pages.
"Request for Inter Partes Reexamination," Exhibit I, filed with the United States Patent and Trademark Office on Nov. 2, 2009, 10 pages.
"Request for Inter Partes Reexamination," Exhibit J, filed with the United States Patent and Trademark Office on Nov. 2, 2009, 23 pages.
"Request for Inter Partes Reexamination," Exhibit K, filed with the United States Patent and Trademark Office on Nov. 2, 2009, 12 pages.
"Request for Inter Partes Reexamination," Exhibit L, filed with the United States Patent and Trademark Office on Nov. 2, 2009, 6 pages.
"Request for Inter Partes Reexamination," Exhibit M, filed with the United States Patent and Trademark Office on Nov. 2, 2009, 1 pages.
"Request for Inter Partes Reexamination," Exhibit N, filed with the United States Patent and Trademark Office on Nov. 2, 2009, 8 pages.
"Request for Inter Partes Reexamination," Exhibit O, filed with the United States Patent and Trademark Office on Nov. 2, 2009, 21 pages.
"Request for Inter Partes Reexamination," Exhibit P, filed with the United States Patent and Trademark Office on Nov. 2, 2009, 12 pages.
"Request for Inter Partes Reexamination," Exhibit Q, filed with the United States Patent and Trademark Office on Nov. 2, 2009, 14 pages.
"Request for Inter Partes Reexamination," Exhibit R, filed with the United States Patent and Trademark Office on Nov. 2, 2009, 7 pages.
"Request for Inter Partes Reexamination," Exhibit S, filed with the United States Patent and Trademark Office on Nov. 2, 2009, 16 pages.
"Request for Inter Partes Reexamination," Exhibit T, filed with the United States Patent and Trademark Office on Nov. 2, 2009, 15 pages.
"Request for Inter Partes Reexamination," Exhibit U, filed with the United States Patent and Trademark Office on Nov. 2, 2009, 8 pages.
"Request for Inter Partes Reexamination," Exhibit V, filed with the United States Patent and Trademark Office on Nov. 2, 2009, 7 pages.
"Request for Inter Partes Reexamination," Exhibit W, filed with the United States Patent and Trademark Office on Nov. 2, 2009, 3 pages.
"Request for Inter Partes Reexamination," Exhibit X, filed with the United States Patent and Trademark Office on Nov. 2, 2009, 4 pages.
*Kolcraft Enterprises, Inc.* v. *Graco Children's Products, Inc. and Chicco USA, Inc.*, "Stipulation for Stay Proceedings Pending Outcome for Reexamination," filed with the United States District Court for the Northern District of Illinois, case No. 09-cv-03339, filed Dec. 3, 2009, 3 pages.
*Kolcraft Enterprises, Inc.* v. *Graco Children's Products, Inc. and Chicco USA, Inc.*, "Notification of Docket Entry," issued by the United States District Court for the Northern District of Illinois, case No. 09-cv-03339, filed Dec. 10, 2009, 1 page.
"Defendant Chicco USA, Inc.'s Identification of Known Prior Art," filed with the United States District Court for the Northern District of Illinois on Dec. 21, 2009, 8 pages.
Graco, "Pack 'N Play Bassinet and Canopy," Owners Manual, 1999, 10 pages.
Graco, "Pack 'N Play," Owners Manual, 2000, 15 pages.
Graco, "Pack 'N Play," Owners Manual, 2001, 20 pages.
Graco, "Pack 'N Play," Owners Manual 2002, 44 pages.
Graco, "Pack 'N Play Canopy," Owners Manual, 2003, 8 pages.
Graco, "Pack 'N Play Playard," Owners Manual, Oct. 2003, 28 pages.
Graco, "Pack 'N Play Playard," Owners Manual, Dec. 2005, 36 pages.
Century, "Fold 'N Go Deluxe Bassinet," Instruction Manual, Sep. 2000, 12 pages.
Century, "Fold 'N Go," retrieved Dec. 14, 2009, 1 page.
Fisher Price, "Bounce and Play," Instuction Manual, 12 pages.
Babytrend Products, "Nursery Care Center and Playard," retrieved Dec. 15, 2009, 1 page.
Babytrend Products, "B. Trend Nursery Center," retrieved Dec. 15, 2009, 1 page.
Tiny Love Products, "Gymini 3-D Activity Gym," retrieved Dec. 15, 2009, 1 page.
Kids II, "Play to Learn Toys," retrieved Dec. 15, 2009, 3 pages.
Kids II, "Pooh Play Gym," retrieved Dec. 15, 2009, 2 pages.
Fisher Price, Kick 'N Crawl Barn, retrieved Dec. 15, 2009, 2 pages.
Baby Product Research, "Essential Baby Products," retrieved Aug. 25, 2009, 24 pages.
Six Innovative New Products Now Available from Evenflo, Business Wire, Decemeber 3, 2002, 2 pages.

United States Patent and Trademark Office, "Notice of Failure to Comply with Inter Partes Reexamination Request Filing Requirements," mailed Dec. 11, 2009, 6 pages.
"Replacement Request for Inter Partes Reexamination," filed with the United States Patent and Trademark Office on Jan. 8, 2010, 131 pages.
"Replacement Request for Inter Partes Reexamination," Exhibit A, filed with the United States Patent and Trademark Office on Jan. 8, 2010, 12 pages.
"Replacement Request for Inter Partes Reexamination," Exhibit B, filed with the United States Patent and Trademark Office on Jan. 8, 2010, 10 pages.
"Replacement Request for Inter Partes Reexamination," Exhibit C, filed with the United States Patent and Trademark Office on Jan. 8, 2010, 13 pages.
"Replacement Request for Inter Partes Reexamination," Exhibit D, filed with the United States Patent and Trademark Office on Jan. 8, 2010, 36 pages.
"Replacement Request for Inter Partes Reexamination," Exhibit E, filed with the United States Patent and Trademark Office on Jan. 8, 2010, 7 pages.
"Replacement Request for Inter Partes Reexamination," Exhibit F, filed with the United States Patent and Trademark Office on Jan. 8, 2010, 16 pages.
"Replacement Request for Inter Partes Reexamination," Exhibit G, filed with the United States Patent and Trademark Office on Jan. 8, 2010, 7 pages.
"Replacement Request for Inter Partes Reexamination," Exhibit H, filed with the United States Patent and Trademark Office on Jan. 8, 2010, 17 pages.
"Replacement Request for Inter Partes Reexamination," Exhibit I, filed with the United States Patent and Trademark Office on Jan. 8, 2010, 10 pages.
"Replacement Request for Inter Partes Reexamination," Exhibit J, filed with the United States Patent and Trademark Office on Jan. 8, 2010, 23 pages.
"Replacement Request for Inter Partes Reexamination," Exhibit K, filed with the United States Patent and Trademark Office on Jan. 8, 2010, 12 pages.
"Replacement Request for Inter Partes Reexamination," Exhibit L, filed with the United States Patent and Trademark Office on Jan. 8, 2010, 6 pages.
"Replacement Request for Inter Partes Reexamination," Exhibit M, filed with the United States Patent and Trademark Office on Jan. 8, 2010, 1 page.
"Replacement Request for Inter Partes Reexamination," Exhibit N, filed with the United States Patent and Trademark Office on Jan. 8, 2010, 8 pages.
"Replacement Request for Inter Partes Reexamination," Exhibit O, filed with the United States Patent and Trademark Office on Jan. 8, 2010, 21 pages.
"Replacement Request for Inter Partes Reexamination," Exhibit P, filed with the United States Patent and Trademark Office on Jan. 8, 2010, 12 pages.
"Replacement Request for Inter Partes Reexamination," Exhibit Q, filed with the United States Patent and Trademark Office on Jan. 8, 2010, 14 pages.
"Replacement Request for Inter Partes Reexamination," Exhibit R, filed with the United States Patent and Trademark Office on Jan. 8, 2010, 7 pages.
"Replacement Request for Inter Partes Reexamination," Exhibit S, filed with the United States Patent and Trademark Office on Jan. 8, 2010, 16 pages.
"Replacement Request for Inter Partes Reexamination," Exhibit T, filed with the United States Patent and Trademark Office on Jan. 8, 2010, 15 pages.
"Replacement Request for Inter Partes Reexamination," Exhibit U, filed with the United States Patent and Trademark Office on Jan. 8, 2010, 8 pages.
"Replacement Request for Inter Partes Reexamination," Exhibit V, filed with the United States Patent and Trademark Office on Jan. 8, 2010, 7 pages.
"Replacement Request for Inter Partes Reexamination," Exhibit W, filed with the United States Patent and Trademark Office on Jan. 8, 2010, 3 pages.
"Replacement Request for Inter Partes Reexamination," Exhibit X, filed with the United States Patent and Trademark Office on Jan. 8, 2010, 4 pages.
United States Patent and Trademark Office, "Decision on Request for Inter Partes Reexamination," issued in connection with U.S. Appl. No. 95/000,514, corresponding to US patent 7,376,993 issued from U.S. Appl. No. 10/725,071, mailed Feb. 12, 2010, 27 pages.
United States Patent and Trademark Office, "Inter Partes Reexamination Office Action," issued in connection with U.S. Appl. No. 95/000,514, corresponding to US patent 7,376,993 issued from U.S. Appl. No. 10/725,071, mailed Feb. 12, 2010, 21 pages.
"Response to the Office Action Dated Feb. 12, 2010," filed with the United States Patent and Trademark Office in connection with U.S. Appl. No. 95/000,514, corresponding to US patent 7,376,993 issued from U.S. Appl. No. 10/725,071, Mar. 12, 2010, 50 pages.
"Response to the Office Action Dated Feb. 12, 2010," Appendix A, Rule 131 Declaration of James A. Flight, with exhibits 1-7, filed with the United States Patent and Trademark Office in connection with U.S. Appl. No. 95/000,514, corresponding to US patent 7,376,993 issued from U.S. Appl. No. 10/725,071, Mar. 12, 2010, 12 pages.
"Response to the Office Action Dated Feb. 12, 2010," Appendix B, filed with the United States Patent and Trademark Office in connection with U.S. Appl. No. 95/000,514, corresponding to US patent 7,376,993 issued from U.S. Appl. No. 10/725,071, Mar. 12, 2010, 4 pages.
"Response to the Office Action Dated Feb. 12, 2010," Appendix C, filed with the United States Patent and Trademark Office in connection with U.S. Appl. No. 95/000,514, corresponding to US patent 7,376,993 issued from U.S. Appl. No. 10/725,071, Mar. 12, 2010, 4 pages.
"Response to the Office Action Dated Feb. 12, 2010," Appendix D, filed with the United States Patent and Trademark Office in connection with U.S. Appl. No. 95/000,514, corresponding to US patent 7,376,993 issued from U.S. Appl. No. 10/725,071, Mar. 12, 2010, 9 pages.
"Response to the Office Action Dated Feb. 12, 2010," Appendix E, filed with the United States Patent and Trademark Office in connection with U.S. Appl. No. 95/000,514, corresponding to US patent 7,376,993 issued from U.S. Appl. No. 10/725,071, Mar. 12, 2010, 12 pages.
*Kolcraft Enterprises, Inc.* v. *Graco Children's Products, Inc. and Chicco USA, Inc.*, "Report on the Filing of Determination of an Action Regarding a Patent or Trademark," filed with the United States District Court, Northern District of Illinois, Eastern Division, on Apr. 6, 2012, Case:1:09-cv-03339, Document #:114, referencing reexamination control No. 95000514, corresponding to patent 7,376,993, 1 page.
*Kolcraft Enterprises, Inc.* v. *Graco Children's Products, Inc. and Chicco USA, Inc.*, "Statement," filed with the United States District Court, Northern District of Illinois, Eastern Division, on Apr. 5, 2012, Case:1:09-cv-03339, Document #:113, referencing reexamination control No. 95000514, corresponding to patent 7,376,993, 2 pages.
*Kolcraft Enterprises, Inc.* v. *Graco Children's Products, Inc. and Chicco USA, Inc.*, "Notice of Issuance of Right to Appeal Notice in Reexamination," filed with the United States District Court, Northern District of Illinois, Eastern Division, on Apr. 4, 2012, Case:1:09-cv-03339, Document #:111, referencing reexamination control No. 95000514, corresponding to patent 7,376,993, 2 pages.
*Kolcraft Enterprises, Inc.* v. *Graco Children's Products, Inc. and Chicco USA, Inc*, "Notice of Issuance of Right to Appeal Notice in Reexamination," Exhibit 1, filed with the United States District Court, Northern District of Illinois, Eastern Division, on Apr. 4, 2012, Case:1:09-cv-03339, Document #:111-1, referencing reexamination control No. 95000514, corresponding to patent 7,376,993, 51 pages.
*Kolcraft Enterprises, Inc.* v. *Graco Children's Products, Inc. and Chicco USA, Inc.*, "Revised Discovery Plan," filed with the United States District Court, Northern District of Illinois, Eastern Division, on Mar. 9, 2012, Case:1:09-cv-03339, Document #:97, referencing reexamination control No. 95000514, corresponding to patent 7,376,993, 6 pages.

*Kolcraft Enterprises, Inc.* v. *Graco Children's Products, Inc. and Chicco USA, Inc.*, "Notification of Docket Entry," issued by the United States District Court, Northern District of Illinois, Eastern Division, on Mar. 7, 2012, Case:1:09-cv-03339, Document #:96, referencing reexamination control No. 95000514, corresponding to patent 7,376,993, 1 page.
"Notice of Appeal to the Board of Patent Appeals and Interferences" filed with the United States Patent and Trademark Office on Apr. 18, 2012, in connection with reexamination control No. 95000514, corresponding to patent 7,376,993, 9 pages.
United States Patent and Trademark Office, "Right of Appeal Notice," issued in connection with reexamination control No. 95000514, corresponding to patent 7,376,993, mailed Mar. 21, 2012, 50 pages.
"Appeal Brief of Third Party Requester Pursuant to 37 C.F.R. 41.67," filed with the United States Patent and Trademark Office on Jun. 15, 2012, in connection with reexamination control No. 95000514, corresponding to patent 7,376,993, 57 pages.
"Appeal Brief of Third Party Requester Pursuant to 37 C.F.R. 41.67," Exhibit 1, filed with the United States Patent and Trademark Office on Jun. 15, 2012, in connection with reexamination control No. 95000514, corresponding to patent 7,376,993, 13 pages.
"Appeal Brief of Third Party Requester Pursuant to 37 C.F.R. 41.67," Exhibit 2, filed with the United States Patent and Trademark Office on Jun. 15, 2012, in connection with reexamination control No. 95000514, corresponding to patent 7,376,993, 9 pages.
"Appeal Brief of Third Party Requester Pursuant to 37 C.F.R. 41.67," Exhibit 3, filed with the United States Patent and Trademark Office on Jun. 15, 2012, in connection with reexamination control No. 95000514, corresponding to patent 7,376,993, 4 pages.
"Appeal Brief of Third Party Requester Pursuant to 37 C.F.R. 41.67," Exhibit 4, filed with the United States Patent and Trademark Office on Jun. 15, 2012, in connection with reexamination control No. 95000514, corresponding to patent 7,376,993, 15 pages.
"Appeal Brief of Third Party Requester Pursuant to 37 C.F.R. 41.67," Exhibit 5, filed with the United States Patent and Trademark Office on Jun. 15, 2012, in connection with reexamination control No. 95000514, corresponding to patent 7,376,993, 26 pages.
"Appeal Brief of Third Party Requester Pursuant to 37 C.F.R. 41.67," Exhibit 6, filed with the United States Patent and Trademark Office on Jun. 15, 2012, in connection with reexamination control No. 95000514, corresponding to patent 7,376,993, 17 pages.
"Appeal Brief of Third Party Requester Pursuant to 37 C.F.R. 41.67," Exhibit 7, filed with the United States Patent and Trademark Office on Jun. 15, 2012, in connection with reexamination control No. 95000514, corresponding to patent 7,376,993, 8 pages.
"Appeal Brief of Third Party Requester Pursuant to 37 C.F.R. 41.67," Exhibit 8, filed with the United States Patent and Trademark Office on Jun. 15, 2012, in connection with reexamination control No. 95000514, corresponding to patent 7,376,993, 22 pages.
"Appeal Brief of Third Party Requester Pursuant to 37 C.F.R. 41.67," Exhibit 9, filed with the United States Patent and Trademark Office on Jun. 15, 2012, in connection with reexamination control No. 95000514, corresponding to patent 7,376,993, 13 pages.
"Appeal Brief of Third Party Requester Pursuant to 37 C.F.R. 41.67," Exhibit 10, filed with the United States Patent and Trademark Office on Jun. 15, 2012, in connection with reexamination control No. 95000514, corresponding to patent 7,376,993, 9 pages.
"Appeal Brief of Third Party Requester Pursuant to 37 C.F.R. 41.67," Exhibit 11, filed with the United States Patent and Trademark Office on Jun. 15, 2012, in connection with reexamination control No. 95000514, corresponding to patent 7,376,993, 8 pages.
"Appeal Brief of Third Party Requester Pursuant to 37 C.F.R. 41.67," Exhibit 12, filed with the United States Patent and Trademark Office on Jun. 15, 2012, in connection with reexamination control No. 95000514, corresponding to patent 7,376,993, 16 pages.
"Appeal Brief of Third Party Requester Pursuant to 37 C.F.R. 41.67," Exhibit 13, filed with the United States Patent and Trademark Office on Jun. 15, 2012, in connection with reexamination control No. 95000514, corresponding to patent 7,376,993, 8 pages.
"Boppy 5-in-1," from Sensational Beginnings catalog, p. 43 (1 page).
"Gymini Deluxe—Black White Red," from http://www.babyuniverse.com/pro.asp?id=5268 &rc=qDTeQF8fpnOZAnH80SY@&siteid=0041024721, May 2004 (1 page).
"Respondent Brief," filed with the United States Patent and Trademark Office on Jul. 15, 2012, in connection with reexamination control No. 95000514, corresponding to patent 7,376,993, 15 pages.
"Respondent Brief," Exhibit A, filed with the United States Patent and Trademark Office on Jul. 15, 2012, in connection with reexamination control No. 95000514, corresponding to patent 7,376,993, 17 pages.
"Respondent Brief," Exhibit B, filed with the United States Patent and Trademark Office on Jul. 15, 2012, in connection with reexamination control No. 95000514, corresponding to patent 7,376,993, 9 pages.
"Respondent Brief," Exhibit C, filed with the United States Patent and Trademark Office on Jul. 15, 2012, in connection with reexamination control No. 95000514, corresponding to patent 7,376,993, 26 pages.
"Respondent Brief," Exhibit D, filed with the United States Patent and Trademark Office on Jul. 15, 2012, in connection with reexamination control No. 95000514, corresponding to patent 7,376,993, 22 pages.
"Respondent Brief," Exhibit E, filed with the United States Patent and Trademark Office on Jul. 15, 2012, in connection with reexamination control No. 95000514, corresponding to patent 7,376,993, 8 pages.
"Respondent Brief," Exhibit F, filed with the United States Patent and Trademark Office on Jul. 15, 2012, in connection with reexamination control No. 95000514, corresponding to patent 7,376,993, 16 pages.
"Respondent Brief," Exhibit G, filed with the United States Patent and Trademark Office on Jul. 15, 2012, in connection with reexamination control No. 95000514, corresponding to patent 7,376,993, 9 pages.
"Respondent Brief," Exhibit H, filed with the United States Patent and Trademark Office on Jul. 15, 2012, in connection with reexamination control No. 95000514, corresponding to patent 7,376,993, 8 pages.
Response to Inter Party Reexamination Office action dated Dec. 22, 2010, filed with the United States Patent and Trademark Office on Jan. 24, 2011, in connection with U.S. Appl. No. 95/000,514, corresponding to U.S. Patent 7,376,993, issued from U.S. Appl. No. 10/725,071, 22 pages.
United States Patent and Trademark Office Inter Party Reexamination Office action issued in connection with U.S. Appl. No. 95/000,514, corresponding to U.S. Patent 7,376,993, issued from U.S. Appl. No. 10/725,071, mailed Dec. 22, 2010, 52 pages.

* cited by examiner

PLAY GYMS AND METHODS OF OPERATING THE SAME

RELATED APPLICATION

This patent issues from a continuation of U.S. patent application Ser. No. 10/725,071, which was filed on Dec. 1, 2003 and which claims priority from U.S. patent application Ser. No. 10/431,079 which was filed on May 7, 2003.

FIELD OF THE DISCLOSURE

This disclosure relates generally to child care products, and, more particularly, to play gyms and methods of operating the same.

BACKGROUND

In recent years, portable play yards have become very popular. Portable play yards typically include a frame, a fabric enclosure supported by the frame, and a removable floor board or mat. The frame is largely or completely contained within the fabric enclosure so that there are few if any loose parts when the frame is collapsed or when the frame is erected. When collapsed, the portable play yard typically has a compact form factor to enable easy transport and storage of the play yard. Sometimes, the floor board is wrapped around the collapsed frame to prevent the frame from inadvertently leaving the collapsed state.

Sometimes, these portable play yards are provided with a portable bassinet. The portable bassinet is typically suspended within the top of the play yard by hooking the bassinet to the upper rails of the play yard frame and permitting the bassinet to extend downward into the enclosure of the play yard. With the exception of depth (which is significantly lower, often one-quarter to one half the depth of the play yard enclosure), the bassinet may have substantially the same size as the play yard enclosure (i.e., substantially the same width and length), or may be smaller than the play yard enclosure (e.g., substantially the same width but approximately one-half the length). The bassinet is used with infants. When the bassinet is installed, the play yard enclosure cannot be occupied by a child, although the area below the bassinet may sometimes be used for storage of inanimate objects. When the child grows sufficiently, the bassinet is removed from the play yard and the play yard is used to house the child.

The floor mat of the play yard may be used as the floor of the play yard and/or the bassinet. In examples in which the bassinet has a smaller floor area than the play yard that supports the bassinet, the floor board may be folded (e.g., doubled up) to be used as the floor of the bassinet and fully extended to be used as the floor of the play yard.

Mats for use on a floor with an over-arching play gym have also become popular in recent years. For instance, in a known prior art device, a play gym having two flexible arches for suspending objects such as toys or the like is coupled to the corners of a rectangular mat via snaps or the like. The arches cross and are snapped to one another roughly above the middle of the mat. A small child placed on the mat may be entertained by the suspended objects. Because the play gym's arches are flexible, the suspended objects tend to bounce and move in response to vibrations such as those that might be caused by the child batting his/her hands and/or feet at the objects.

DETAILED DESCRIPTION

Figure 1:
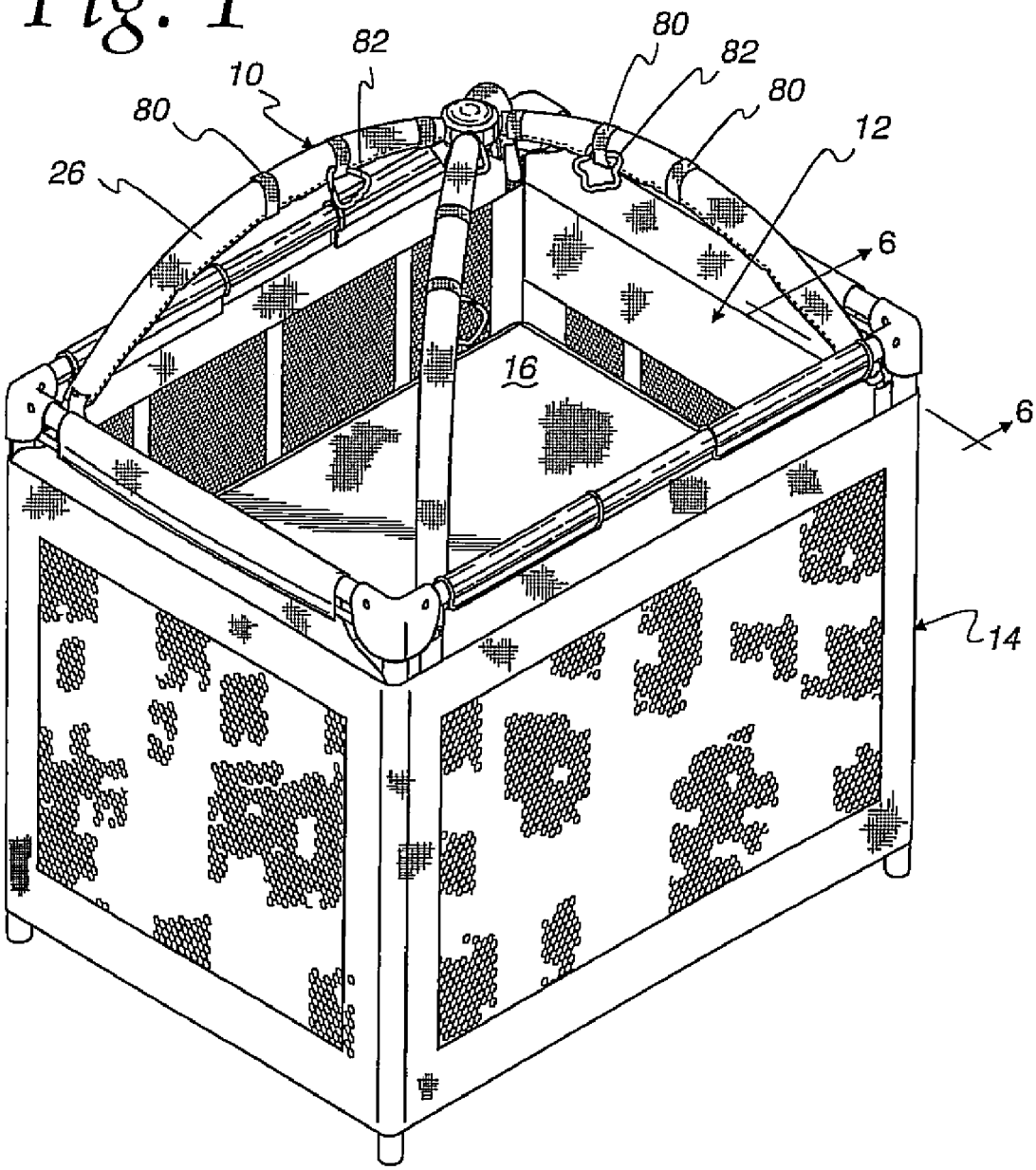
FIG. 1 is a perspective view of an example play yard, an example bassinet, and an example play gym.
Figure 2:
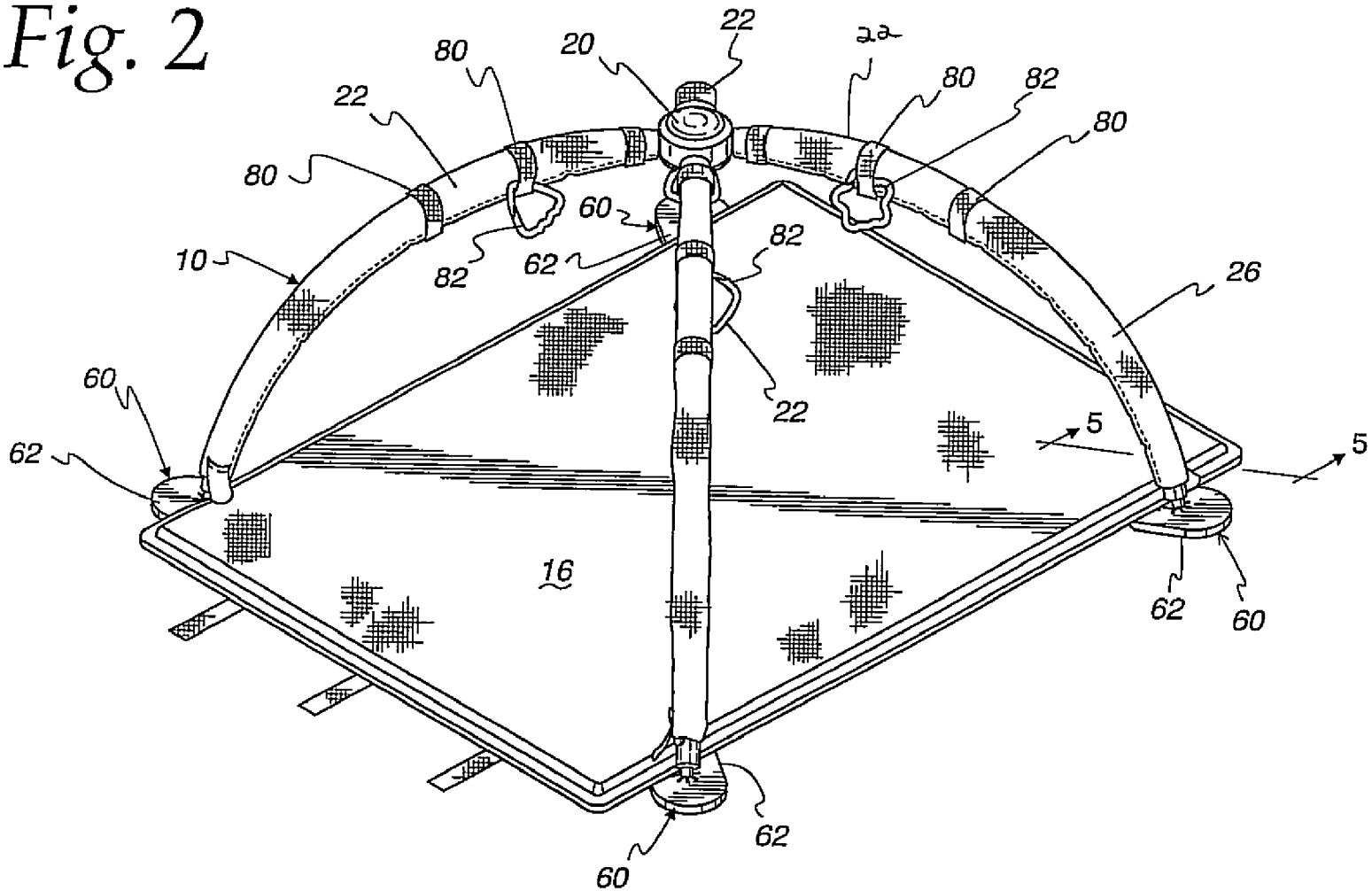
FIG. 2 is a perspective view of the example play gym of FIG. 1 when removed from the play yard and bassinet, and coupled to a floor mat of the play yard and bassinet.

FIG. 1 is a perspective view of an example play gym 10 mounted to an example bassinet 12 which is, in turn, mounted to an example portable play yard 14. The illustrated play gym 10 is structured to suspend an object such as a toy above the bassinet 12 and/or the play yard 14 as explained below. Additionally, the play gym 10 is structured to suspend the same or a different object above a mat 16 separate from the bassinet 12 and the play yard 14 as shown in FIG. 2. In the illustrated example, the mat 16 is a removable floor board or mat 16 which is used as the floor of at least one of the bassinet 12 and the play yard 14. Thus, as shown in FIG. 1, the illustrated play gym 10 has a first mode in which it suspends an object above the mat 16 when the mat 16 is positioned in the bassinet 12 and/or the play yard 14. As shown in FIG. 2, the play gym 10 also has a second mode in which it suspends the same or a different object above the mat 16 when the mat is removed from the bassinet 12 and/or the play gym 14, and the mat 16 is positioned on another surface such as the floor of a house. Whereas in the first mode, the play gym 10 supports the object above any or all of the bassinet 12, the play yard 14, and the mat 16, in the second mode the play gym 10 supports the object above the mat 16, but not above the play yard 14 or the bassinet 12.

The play yard 14 may be constructed in any manner. For example, it can be constructed like any of the portable play yards sold by such companies as Kolcraft Enterprises, Graco Children's Products, Evenflo, Cosco, etc. The play yard 14 may collapse into a rectangular package, may fold into a generally planar configuration (e.g., by folding in half), and/or may not be foldable. Although shown as a rectangular structure, the play yard 14 may have any other desired shape or configuration (e.g., square, triangular, round, etc.)

Similarly, the bassinet 12 may be constructed in any desired manner and/or shape. For example, the bassinet 12 may be constructed like any of the bassinets sold by such companies as Kolcraft Enterprises, Graco Children's Products, Evenflo, Cosco, etc. For instance, the bassinet 12 may be a framed or frameless bassinet that is removably suspended by hooks, snaps or any other type of fastening technique within the play yard 14. The bassinet 12 may have the same general shape and floor area as the play yard 14 as shown in FIG. 1, or may have a different shape and/or less floor space then the play yard 14 (e.g., half the floor space of the play yard 14). Alternatively, the bassinet 12 may be a stand alone unit that is not intended for use with a play yard, is erected apart from a play yard 12, and/or is not collapsible.

As mentioned above, in the illustrated example the floor mat 16 is adapted for use as a floor for the bassinet 12 and/or the play yard 14. Thus, the floor mat 16 is dimensioned to be positioned within at least one of the bassinet 12 and the play yard 14. Since, in the illustrated example, the play yard 14 and the bassinet 12 are not intended to be in use at the same time, one floor mat 16 is provided for use with both the play yard 14 and the bassinet 12 and, thus, the floor mat 16 is dimensioned to be used with both of those structures. Alternatively, two different floor mats 16 of the same or different size and/or construction may be provided.

As used herein, the terms "floor mat" and "floor board" are equivalent and interchangeable. The floor mat 16 may be implemented in any desired manner. For example, the floor mat 16 may be a completely flexible mat made of foam, cloth, plastic and/or other materials. In the illustrated example, however, the floor mat 16 is at least partially rigid to provide a substantially solid floor for the play yard 14 and/or bassinet 12 and to provide enhanced support for a child disposed on the mat 16. In examples in which the floor mat 16 is at least partially rigid, the floor mat 16 may include a pad secured to one or more boards. The pad and board(s) may be encased in a plastic sleeve as is conventional in portable play yards sold today such as the Travelin' Tot play yard sold by Kolcraft Enterprises. If the floor mat 16 includes multiple boards, adjacent boards may be positioned along a seam to facilitate folding of the mat 16 in discrete sections. For example, the floor mat 16 may include four solid boards and be foldable in fourths for wrapping around the collapsed play yard 12 during storage and/or transport. In the illustrated example, the play yard 14 and the bassinet 12 have substantially the same floor space and the floor mat 16 is, thus, inserted into the play yard 14 and the bassinet 12 in substantially the same orientation (e.g., flat without folding). In examples in which the bassinet 12 and the play yard 14 have different sizes and/or shapes, the floor mat 16 may be folded (e.g., in half) for insertion into one or both of the bassinet 12 and/or the play yard 14.

The floor mat 16 may be removably secured in the bassinet 12 and/or the play yard 16 by any suitable fasteners. For example, the floor mat 16 may be secured to the bassinet 12 and/or the play yard 16 by Velcro strips. Alternatively, the floor mat 16 may be held in place by gravity without the benefit of fasteners.

The illustrated play gym 10 includes a hub 20 and four legs 22, although persons of ordinary skill in the art will readily appreciate that no hub and/or fewer or more than four legs 22 may alternatively be employed. For instance, the play gym 10 may include only one leg that forms an arch over the mat 16, the bassinet 12, and/or the play yard 14 without the benefit of a hub. Alternatively, the play gym 10 may include two or more legs that cross near the center of the mat 16, the bassinet 12 and/or the play yard 14; again with or without the benefit of a hub. The legs may form crossing arches and the arches may be coupled to one another either directly or through a hub.

Figure 3:
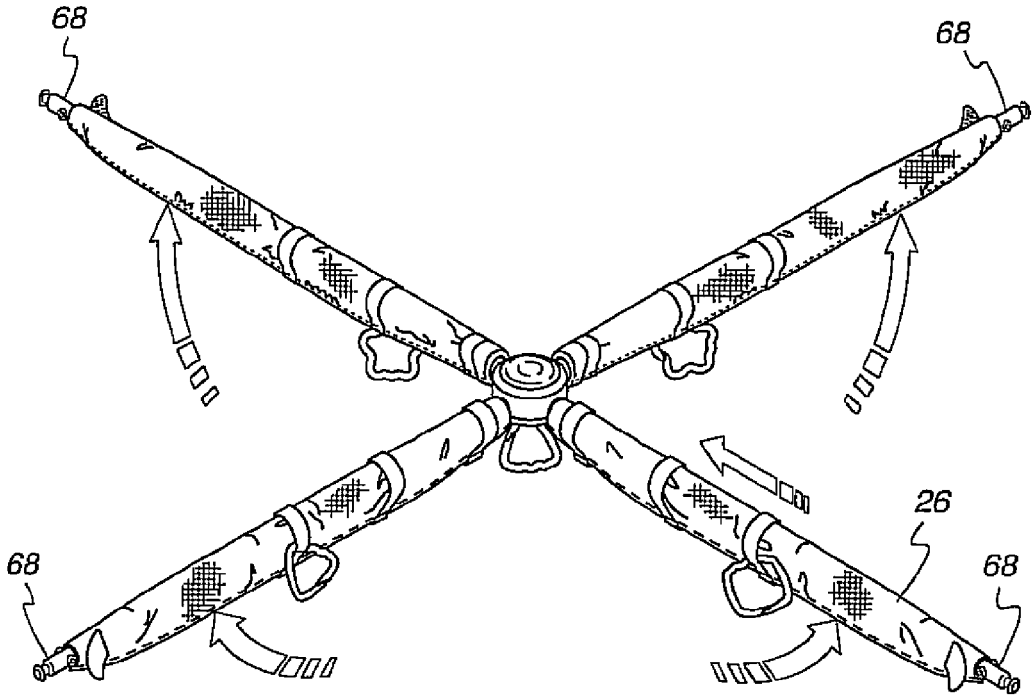
FIG. 3 illustrates the example play gym of FIGS. 1 and 2 in an expanded state before the play gym is coupled to a play yard, a bassinet or a floor mat.

In the illustrated example, the legs 22 of the play gym 12 are flexible such that they can be bent into the arched position shown in FIGS. 1 and 2, but will spring back to the generally planar position shown in FIG. 3 when released from the mat 16, the bassinet 12, and/or the play yard 14. In the illustrated example, the legs 22 are implemented by flexible plastic tubes 24 (see FIGS. 5 and 7-9) encased in a plastic, vinyl, or cloth covering 26 (see FIGS. 5 and 6), although legs of other forms and materials with or without coverings of the same or different materials may likewise be employed.

Figure 4:
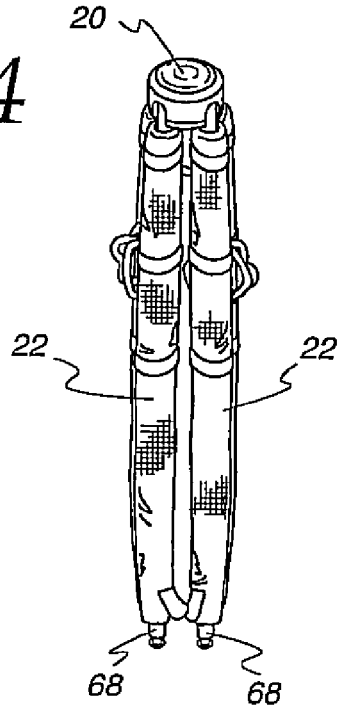
FIG. 4 illustrates the example play gym of FIG. 3 in a folded state.

In the illustrated example, the legs 22 are pivotably coupled to the hub 20 such that they can be pivoted between a stored position wherein the legs 22 are positioned generally parallel to each other as shown in FIG. 4, and an extended position wherein the legs 22 extend generally radially outward from the hub 20 as shown in FIG. 3. Persons of ordinary skill in the art will readily appreciate that the legs 22 may be coupled to the hub 20 in any number of ways. In the illustrated example, each of the legs 22 defines a slot 30 (see FIGS. 7-9) and the hub 20 includes a plurality of pins 32. Each of the pins 32 is positioned in a respective one of the slots 30. The pins 32 and slots 30 are dimensioned such that each of the legs 22 may pivot about its respective pin 32 and/or slide along its respective longitudinal axis toward and away from the hub 20. The permitted slide distance is defined by the size of the corresponding slot 30 and pin 32.

Figure 7:
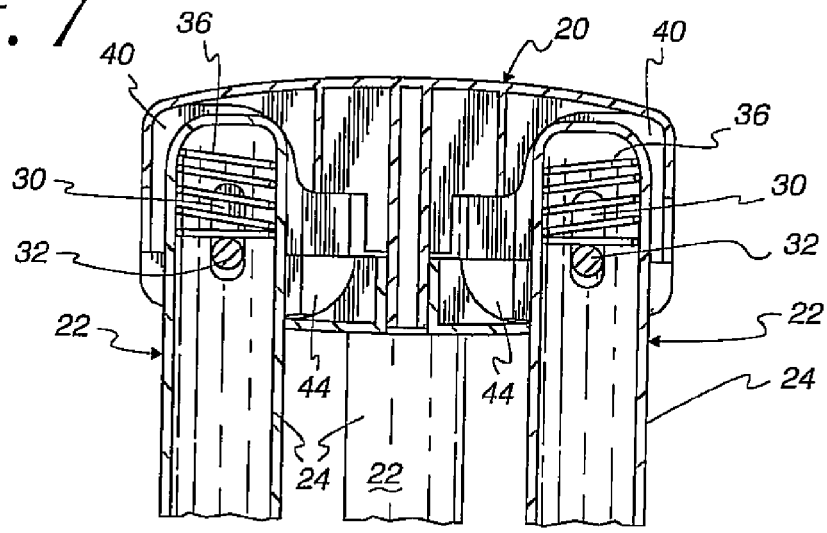
FIG. 7 is a cross-sectional view of the hub and some of the legs of the example play gym of FIGS. 1-6 and showing the legs in a folded position suitable for storing the play gym.
Figure 8:
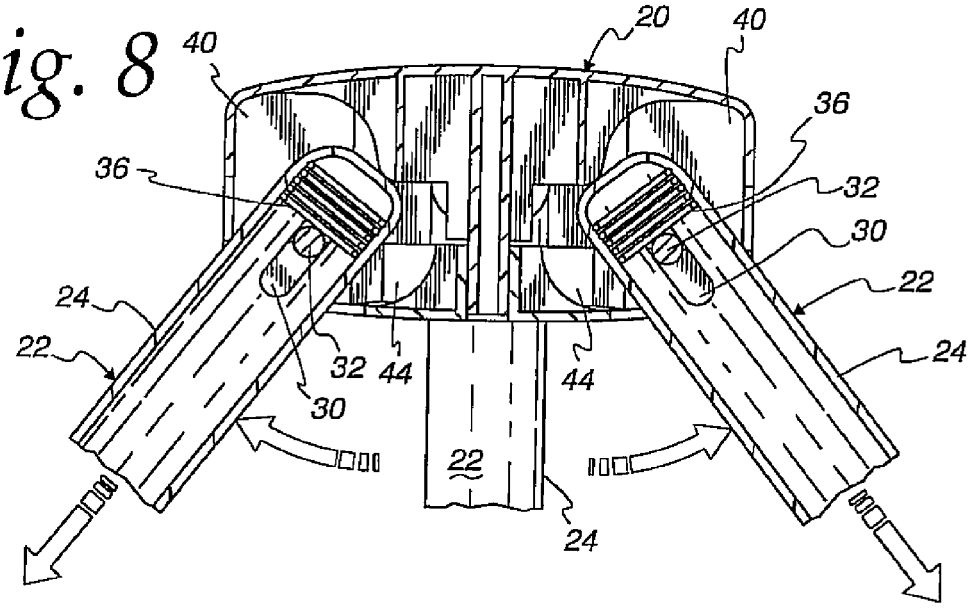
FIG. 8 is a view similar to FIG. 7, but showing the legs being moved between the extended and locked positions.
Figure 9:
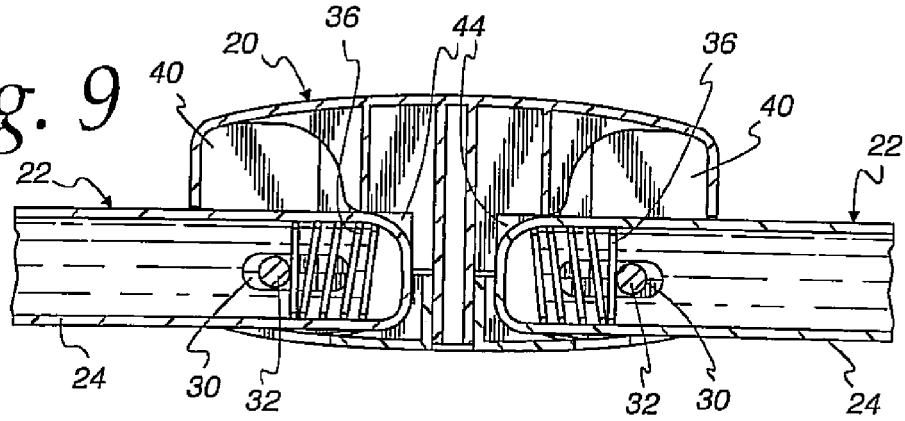
FIG. 9 is a view similar to FIG. 7, but showing some of the legs in the extended position suitable for erecting the play gym.

To bias the legs 22 toward the hub 20, each of the legs is further provided with a spring 36. As shown in FIGS. 7-9, in the illustrated example the springs 36 are helical springs located within respective ones of the legs 22. One end of each of the springs 36 is positioned adjacent an inner end of its respective leg 22, while the other end of each spring 36 abuts one of the pins 32. As a result, absent a countervailing force, the springs 36 force the pins 32 toward the bottom of their respective slots 30 (see FIGS. 7 and 9). In other words, the springs 36 force their respective legs 22 toward the hub 20 unless a countervailing force is applied pulling the legs away from the hubs 20.

To define the stored and extended positions of the legs 22, the hub 20 defines a plurality of cavities 40, 44. A first set of the cavities 40 is positioned to prevent the legs 22 from pivoting when the legs 22 are in the stored position. The second set of cavities 44 is positioned to prevent the legs 22 from pivoting when the legs 22 are in the extended position. Thus, each of the legs 22 is associated with a pair of cavities, namely, one of the cavities 40 from the first set and one of the cavities 44 from the second set.

More specifically, each of the cavities 40, 44 is dimensioned to receive an end of a respective one of the legs 22 when the leg 22 is in one of the stored position and the extended position. As discussed above, the springs 36 bias the legs toward the hub 20. This biasing force biases the legs 22 into engagement with respective ones of the cavities 40, 44. When the ends of the legs 22 are positioned in a corresponding cavity 40, 44, the walls of the cavity 40, 44 prevent the legs 22 from pivoting out of the cavity. Thus, when an end of a leg 22 is positioned in its first corresponding cavity 40, the walls of the cavity 40 prevent the leg 22 from pivoting out of the stored position. Similarly, when the end of the leg 22 is positioned in its second corresponding cavity 44, the walls of the cavity 44 prevent the leg from pivoting out of the extended position. As a result, when it is desirable to pivot a leg 22 between the extended and stored positions, a user must pull that leg 22 against the force of the spring 36 a distance away from the hub 20 such that the end of the leg 22 can be pivoted out of one of the cavities 40, 44 and into the other one of the cavities 40, 44 (see FIG. 8). The dimensions of the slots 30 are, therefore, chosen to permit sufficient longitudinal movement of the legs 22 to permit withdrawal of the legs 22 from the cavities 40, 44. As shown in FIGS. 7-9, in the illustrated example, the cavities 40, 44 of each pair of cavities are positioned at generally right angles so that the corresponding leg 22 must be pivoted approximately ninety degrees to move that leg between the extended and stored positions.

To removably couple the play gym 10 to at least one of the bassinet 12 and the play yard 14, at least one of the mat 16, the bassinet 12 and the play yard 14 is provided with connectors 50. Persons of ordinary skill in the art will readily appreciate that the connectors 50 may be implemented in any number of ways. In the illustrated example, the connectors 50 are implemented by fabric pockets 50 which are sewn or otherwise fastened adjacent the corners of the bassinet 12 and/or the play yard 14 (see FIG. 6). The ends of the legs 22 opposite the hub 20 are positioned in respective ones of these pockets 50 to thereby couple the play gym 10 to the bassinet 12 and/or the play yard 14. As shown in FIG. 1, to position all of the legs 22 in their corresponding pockets 50, the legs 22 must be bent into an arcuate shape thereby causing the play gym 10 to form a pair of arches crossing one another at the hub 20 over the bassinet 12 and/or the play yard 14. Preferably, the lengths of the legs 22 are selected to be substantially equal such that the arches cross in the middle of the bassinet 12 and/or the play yard 14 (i.e., such that the hub 20 or, if no hub is present, the point of crossing of the legs 22, is located above the center of the bassinet 12 and/or the play yard 14).

Preferably the legs 22 are selected such that, after being bent, the legs 22 will seek to return to their original, generally straight condition (see FIG. 3). As a result, when the legs 22 are bent into the arched position shown in FIG. 1, each of the ends of the legs 22 will apply a force away from the center of the bassinet 12 and/or the play yard 14 seeking to return the legs 22 into the straight position. These forces act to bias the hub 20 upward away from the bassinet 12 and/or the play yard 14 and to bias the free ends of the legs 22 into tight engagement with the sides of the pockets 50 (and, thus, with the frame of the bassinet 12 and/or play yard 14) to thereby securely hold the play gym 10 above the bassinet 12 and/or the play yard 14.

While in the illustrated example the connectors 50 are located on the bassinet 12, connectors 50 could alternatively or additionally be located on the play yard 14 such that, if desired, the play gym 10 could be mounted to the play yard 14 without the bassinet 12. Alternatively, no connectors 50 may be located on the bassinet 12 and/or the play yard 16, and the play gym 10 can instead be coupled to the bassinet 12 and/or the play yard 14 via direct connection to the mat 16. In such an approach, the mat 16 may include non-pivoting connectors located within the perimeter of the mat 16 and accessible from the top of the mat 16 to permit the mat 16 to be inserted and/or withdrawn from the bassinet 12 and/or play yard 14 without interference from the connectors and possibly with the play gym 10 still attached to the mat 16.

To removably couple the play gym 10 to the mat 16, the mat 16 is further provided with a plurality of connectors 60. To removably join the legs 22 to the connectors 60, each of the legs 22 preferably terminates in a foot 68 having a diameter approximately equal to the diameter of the leg 22, and a reduced diameter ankle 70 located between the foot 68 and the leg 22 (see FIG. 5). The feet 68 and ankles 70 may be integrally formed into a single piece and fastened to their corresponding legs 22 by a fastener such as a rivet as shown in FIGS. 3 and 8, or may be integrally formed with their corresponding legs 22.

Figure 5:
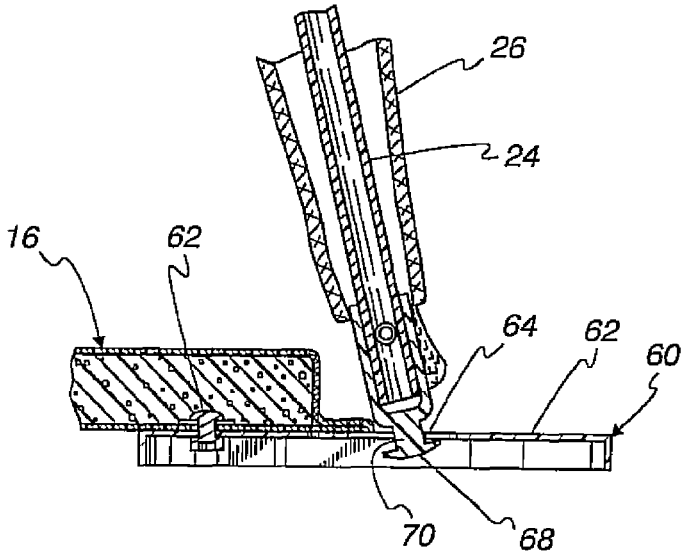
FIG. 5 is a cross-sectional view of an example connector joining the example play gym of FIGS. 1-4 to the example floor board of FIG.
Figure 6:
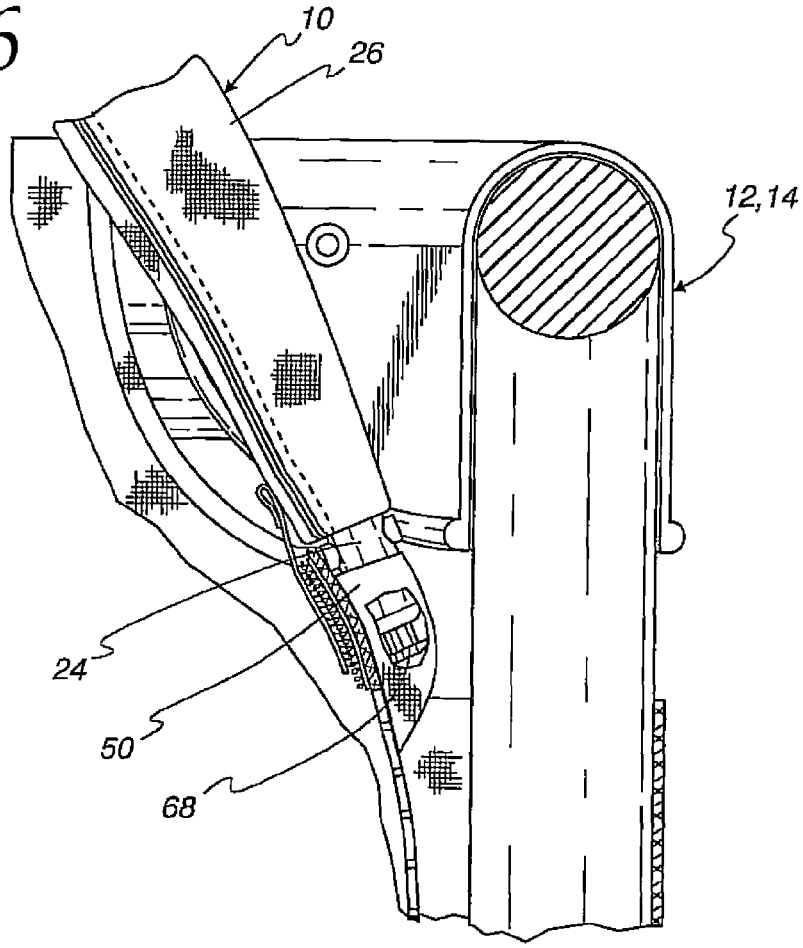
FIG. 6 is a partial cross-sectional view of an example connector joining the example play gym of FIGS. 1-5 to an example bassinet or play yard.

As shown in FIGS. 2 and 5, in the illustrated example each of the connectors 60 is implemented by a plate 62 that defines an aperture 64 for receiving a respective one of feet 68 of the legs 22. Preferably, each of the apertures 64 comprises an enlarged end or opening dimensioned to receive the foot 68 of a respective one of the legs 22. The enlarged end of the aperture 64 is in communication with a longitudinal slot having a length and a width. The width of each slot is preferably smaller than the diameter of the foot 68 and slightly larger than the diameter of the ankle 70 such that the leg 22 can easily move along the slot without withdrawing from the aperture 64. The end of the aperture 64 opposite the enlarged end may include radial slots 74 as shown in FIG. 2 to facilitate withdrawal of the feet 68 when desired.

In the illustrated example, each of the connectors 60 is pivotably coupled to the mat 16 for movement between a first position wherein the plate 62 is entirely within the perimeter of the mat 16 and a second position wherein the plate 62 lies at least partially outside of the perimeter of the mat 16. In the illustrated example, the plate 62 is pivotably coupled to the underside of the mat 16 via a rivet 62 (see FIG. 5). Thus, when the plate 62 is moved to its first position (i.e., within the perimeter of the mat 16), the connector 60 is located beneath the mat 16, but when the plate 62 is moved to its second position, at least a portion of the connector 60 is not disposed beneath the mat 16. Since, in the illustrated example, the mat 16 is intended to be used as the floor of the bassinet 12 and the play yard 14, the perimeter of the mat 16 closely matches the inner perimeter of the floor of the bassinet 12 and the inner perimeter of the floor of the play yard 14. As a result, when the user desires to use the mat 16 in one of the bassinet 12 and the play yard 14, the connectors 60 are pivoted in to their first positions so that they do not interfere with positioning the connectors 60 within the bassinet 12 or the play yard 14. When, however, it is desired to use the mat 16 with the play gym 10 apart from the bassinet 12 and/or the play yard 14, the connectors 60 are pivoted to their second positions where they can be engaged by the legs 22 of the play gym 10.

Although in the illustrated example the connectors 60 are coupled to an undersurface of the mat 16, persons of ordinary skill in the art will readily appreciate that the connectors 62 could alternatively be connected to other portions of the mat 16. For example, the connectors 62 may be adapted to move into and out of the side edges of the mat 16 or connected to a top surface of the mat 16. Alternatively, the connectors 62 may not be pivoted to the mat 16 and/or the connectors may be located within the perimeter of the mat 16 to permit coupling of the play gym 10 to the mat 16 when the mat 16 is located within the bassinet 12 and/or the play yard 14.

The enlarged ends of the slots of the apertures 64 are preferably located near the edges of the mat 16 when the connectors 60 are positioned in their extended positions outside of the perimeter of the mat 16. As a result, when the legs 22 are coupled to the connectors 60, they are inserted into the enlarged ends of the apertures 64 near the perimeter of the mat 16. When the legs 22 are released, they will attempt to move from their bent position toward a straight position as explained above. Therefore, the legs 22 are biased to slide away from the perimeter of the mat 16 and away from the enlarged ends of the apertures 64 such that the ankles 70 slide along the slots and the feet 68 run under the plates 62 to thereby secure the legs 22 to the mat 16.

Any or all of the legs 22 of the play gym 10 may be provided with straps 80 and/or split rings 82 to permit objects such as toys to be selectively attached and detached from the play gym 10. Example straps 80 and split rings 82 are shown in FIGS. 1 and 2.

In operation, a user wishing to use the play gym 10 may first erect a bassinet 12 and/or a play yard 14. Erecting the bassinet 12 and/or the play yard 14 may include positioning a floor mat 16 within one or both of the bassinet 12 and the play yard 14. The user may then secure the play gym 10 at least partially above one or both of the bassinet 12 and the play yard 14 by, for example, inserting the feet 68 of the legs 22 into the connectors 50 of the bassinet 12 and/or play yard 14 or into the connectors of the mat 16.

If the user wishes to use the play gym 10 apart from the bassinet 12 and the play yard 14, the user may remove the play gym 10 from the bassinet 12 and/or the play yard 14 by, for example, withdrawing the feet from the connectors 50. If the user desires to use the play gym 10 with the mat 16, the user may then remove the mat 16 from the bassinet 12 and/or the play yard 14 and position the mat 16 in a desired location of use. If pivotable connectors 60 are employed as in the illustrated example, the user may then pivot the connectors 60 out from their first positions within the perimeter of the mat 16 to their second positions outside the perimeter of the mat 16. The user may then secure the play gym 10 to the floor mat 16 by, for example, inserting the feet 68 of the legs 22 into corresponding ones of the apertures 64 of the connectors 60.

If the user desires to store the play gym 10, the user may remove the feet 68 of the legs 22 from the apertures 68 to thereby remove the play gym 10 from the floor mat 16. The user may then collapse the play gym 10 by moving the legs 22 from their extended positions (see FIG. 3) to their stored positions (see FIG. 4). To move a leg 22 to the stored position, the user may pull the leg 22 against the force of the spring 36 in a direction away from the hub 20 such that the end of the leg 22 is withdrawn from the cavity 44 and the leg 22 enters a first intermediate position. The user may then pivot the leg 22 into a second intermediate position and permit the spring 36 to pull the end of the leg 22 into the corresponding cavity 40 of the hub 20 to move the leg 22 into the stored position. The above procedures may be repeated with each of the legs 22 until all of the legs 22 are in the stored position.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus comprising:

at least one of a play yard and a bassinet;

a floor mat dimensioned to substantially cover a floor of at least one of the play yard and the bassinet;

a play gym to suspend an object above the floor mat;

at least one connector to couple the play gym to the mat in proximity to an outer perimeter edge of the floor mat; and at least one fastener to couple the floor mat to at least one of the play yard and the bassinet, the play gym being couplable to the at least one of the floor play yard and the bassinet such that a lowest portion of the play gym is spaced a distance above the floor mat when the floor mat is coupled to the at least one of the play yard and the bassinet, the play gym comprising a plurality of legs joined only at a hub;

wherein at least one of the at least one of the play yard and the bassinet includes connectors to removably couple the play gym to the at least one of the play yard and the bassinet such that the play gym suspends the object above the at least one of the play yard and the bassinet, the connectors of the at least one of the play yard and the bassinet comprising pockets to receive ends of the play gym, and the pockets comprising fabric pockets.

2. An apparatus as defined in claim 1, wherein the at least one connector couples the play gym to the floor mat when the floor mat is removed from the play yard and the bassinet.

3. An apparatus as defined in claim 1, wherein the at least one connector is located in a top surface of the mat.

4. An apparatus, comprising:

a floor mat dimensioned to substantially cover a floor of at least one of a play yard and a bassinet;

a play gym to suspend an object above the floor mat;

at least one connector to couple the play gym to the floor mat adjacent an outer perimeter edge of the floor mat; and at least one fastener to couple the floor mat to at least one of the play yard and the bassinet, the play gym being couplable to the at least one of the floor play yard and the bassinet such that a lowest portion of the play gym is spaced a distance above the floor mat when the floor mat is coupled to the at least one of the play yard and the bassinet, the play gym comprising a plurality of legs joined only at a hub, wherein the at least one connector is located within a perimeter of the mat and is not pivotably coupled to the mat.

5. An apparatus comprising:

a play yard;

a bassinet dimensioned to be removably suspended within the play yard;

a floor mat dimensioned to be positioned in at least one of the play yard and the bassinet such that the floor mat substantially covers a floor of the at least one of the play yard and the bassinet; and a play gym having a first mode in which the play gym suspends an object above at least one of the bassinet and the play yard, and a second mode in which the play gym suspends the object above the mat but not above the at least one of the play yard and the bassinet, wherein, in the first mode, the play gym is secured to the at least one of the play yard and the bassinet a distance above the floor mat with the floor mat located in the at least one of the play yard and the bassinet, wherein the play gym includes a plurality of outwardly biased legs coupled to the floor mat in proximity to respective outer perimeter edges of the floor mat when the play gym is in the second mode, the play gym comprising a plurality of legs joined only at a meeting point above the mat when the play gym is in the second mode.

6. An apparatus comprising:

at least one of a bassinet and a play yard, the at least one of the bassinet and the play yard having a removable floor mat; and a play gym structured to suspend an object above the floor mat when the floor mat is positioned within at least one of the bassinet and the play yard and to suspend the object above the floor mat when the floor mat is not positioned within the at least one of the bassinet and the play gym, the play gym not contacting the floor mat when the floor mat is positioned in the at least one of the bassinet and the play yard, wherein the play gym includes a plurality of outwardly biased legs to be coupled to the floor mat in proximity to respective outer perimeter edges of the floor mat when the floor mat is not positioned within the at least one of the bassinet and the play gym, the plurality of outwardly biased legs converging at only one location.

* * * * *